US006478020B1

(12) United States Patent
Rentz

(10) Patent No.: US 6,478,020 B1
(45) Date of Patent: Nov. 12, 2002

(54) LOOP RELEASE

(75) Inventor: Marc T. Rentz, Madison Heights, VA (US)

(73) Assignee: Gregory E. Summers, Lynchburg, VA (US)

( * ) Notice: Subject to any disclaimer, the term of this patent is extended or adjusted under 35 U.S.C. 154(b) by 0 days.

(21) Appl. No.: 09/773,895

(22) Filed: Feb. 2, 2001

(51) Int. Cl.[7] ..... F41B 5/18
(52) U.S. Cl. ..... 124/35.2
(58) Field of Search ..... 124/35.2

(56) References Cited

U.S. PATENT DOCUMENTS

| | | | | |
|---|---|---|---|---|
| 2,488,597 | A | 11/1949 | Konold | |
| 2,637,311 | A | 5/1953 | Rose | |
| 2,819,707 | A | 1/1958 | Kayfes et al. | |
| 2,965,093 | A | 12/1960 | Arsenault | |
| 3,028,852 | A | 4/1962 | Sutton, Jr. | |
| 3,072,115 | A | 1/1963 | Johnson | |
| 3,929,120 | A | 12/1975 | Barner | |
| 4,022,181 | A | 5/1977 | Fletcher | |
| 4,134,369 | A | 1/1979 | Cook | |
| 4,151,825 | A | 5/1979 | Cook | |
| 4,282,851 | A | 8/1981 | Lyons | |
| 4,509,497 | A | 4/1985 | Garvison | |
| 4,539,968 | A | 9/1985 | Garvison | |
| 4,791,908 | A | 12/1988 | Pellis | |
| 4,831,997 | A | 5/1989 | Greene | |
| 4,881,516 | A | 11/1989 | Peck | |
| 4,926,835 | A | 5/1990 | Peck | 124/35.2 |
| 4,981,128 | A | 1/1991 | Garvison | 124/35.2 |
| 5,020,508 | A | 6/1991 | Greene, Jr. | 124/35.2 |
| 5,070,854 | A | 12/1991 | Peck | 124/35.2 |
| 5,078,116 | A | 1/1992 | Peck | 124/35.2 |
| 5,103,796 | A | 4/1992 | Peck | 124/35.2 |
| 5,247,921 | A | 9/1993 | Todd | 124/35.2 |
| 5,357,939 | A | 10/1994 | Tentler et al. | 124/35.2 |
| 5,370,102 | A | 12/1994 | Peck | 124/35.2 |
| 5,595,167 | A | 1/1997 | Scott | 124/35.2 |
| 5,615,662 | A | 4/1997 | Tentler et al. | 124/35.2 |
| 5,653,214 | A | 8/1997 | Lynn | 124/35.2 |
| 5,680,851 | A | 10/1997 | Summers | 124/35.2 |
| 5,685,286 | A | 11/1997 | Summers | 124/35.2 |
| 5,694,915 | A | 12/1997 | Summers | 124/35.2 |
| 5,857,452 | A | 1/1999 | Troncoso | 124/35.2 |
| 5,937,841 | A | 8/1999 | Summers et al. | 124/35.2 |
| 5,937,842 | A | 8/1999 | Summers et al. | 124/35.2 |
| 6,125,833 | A | 10/2000 | Tentler et al. | 124/35.2 |
| 6,205,991 | B1 | 3/2001 | Summers et al. | 124/35.2 |

*Primary Examiner*—John A. Ricci
(74) *Attorney, Agent, or Firm*—Nixon & Vanderhye P.C.

(57) ABSTRACT

A bowstring release device includes a housing having a longitudinal axis and a center slot opening at a forward end thereof; a sear component pivotably mounted in the housing, the sear component having a jaw movable between a first position where the center slot is open and a second position where the center slot is closed; a trigger component pivotably mounted in the housing, the trigger having a forward projection engageable with the sear component to hold the sear component in the first position and, when the trigger is pulled, to allow the sear component to move to the second position; and a cocking hammer also pivotably mounted the housing, the cocking hammer having a first forwardly extending projection adapted to engage and move the sear component to the second position when the cocking hammer is depressed.

13 Claims, 5 Drawing Sheets

LOOP RELEASE

This invention relates to a bowstring release device and more specifically, to a bowstring release designed especially for use with rope loops.

BACKGROUND AND SUMMARY OF THE INVENTION

Various release devices are utilized in archery to assist the archer in pulling a bowstring to a fully drawn position and then releasing the bowstring to fire the arrow. Many of these devices include mechanical grippers which engage the bowstring directly, or which engage nock elements mounted on the bowstring. Other devices use rope looped about the bowstring as the release mechanism. A back tension rope release is disclosed in my prior U.S. Pat. No. 5,694,915.

It is also known to use wrist straps or "gloves" connected to the release devices to enhance control and accuracy of the release device. Examples of such wrist straps can be found in U.S. Pat. Nos. 5,020,508; 4,981,128; 4,791,908; and 4,509,497.

The present invention relates to an archery wrist strap release designed for use with a rope loop that is tied to the bowstring, or for use around the bowstring itself. In accordance with an exemplary embodiment of the invention, the release includes a release housing attached to a wrist strap by means of a connector plate that allows the release housing to pivot toward and away from the wrist strap. The release housing is also freely rotatable about its own longitudinal axis, relative to the wrist strap.

The release itself includes a substantially cylindrical aluminum housing, bifurcated at its forward end to thereby form interior space for pivotably mounting a sear component including a jaw adapted to open and close the center slot of the housing; a trigger component for releasing the sear component from its closed position, so that the force of the bowstring can open the jaw as the arrow is fired; and a cocking lever used after the rope loop or bowstring is located in the center slot to move the sear so that the jaw closes the center slot around the rope loop or bowstring. The cocking lever also provides an additional safety feature in that it prevents the jaw from opening when held in a depressed position.

More specifically, the sear component includes a forward tongue or jaw which moves forwardly and downwardly in a counterclockwise direction to close the center slot after the bowstring or rope loop has been loaded into the slot. The sear component also includes a forwardly extending projection located behind and below the jaw that includes a forwardly directed, transverse locking edge that is adapted to cooperate with a transverse release edge on the trigger component. The sear component also includes a rearward projection that is adapted to cooperate with the cocking lever.

The trigger component is biased in a forward or clockwise direction, such that the transverse release edge lies adjacent the locking edge on the sear component, preventing the sear component from moving to an open position. When the trigger component is pulled, the trigger release edge engages and slides past the locking edge on the sear component, thereby freeing the sear component to move in an opening direction as a result of force exerted on the jaw as the bowstring moves forward. At the same time, the rearward projection on the sear component engages and pushes the cocking lever in a clockwise direction, but as the sear continues to pivot, a forward projection of the cocking lever changes direction and rides over the top of the sear component to thereby maintain the sear component in an open, cocked position. The release is now in condition for receiving another bowstring or rope loop. Once the bowstring or rope loop is fully inserted within the center slot, the cocking lever may be depressed, thereby freeing the sear component to rotate in a counterclockwise direction such that the jaw closes the center slot. The bowstring can now be drawn to fire another arrow.

It is another feature of the invention that the cocking lever can be depressed while the sear component is closed, thus preventing the sear component from opening and also preventing the trigger from being pulled. This feature is particularly advantageous if the archer decides to "stand down" after the bowstring has been fully drawn. In other words, the archer may depress the cocking lever and then release any pressure on the trigger without fear that the sear component will open accidentally.

Accordingly, in one aspect, the present invention relates to a bowstring release device comprising a housing having a longitudinal axis and a center slot opening at a forward end thereof; a sear component pivotably mounted in the housing, the sear component having a jaw movable between a first position where the center slot is open and a second position where the center slot is closed; a trigger component pivotably mounted in the housing, the trigger having a forward projection engageable with the sear component to hold the sear component in the first position and, when the trigger is pulled, to allow the sear component to move to the second position; and a cocking lever also pivotably mounted in the housing, the cocking lever having a first forwardly extending projection adapted to engage and move the sear component to the second position when the cocking lever is depressed.

In another aspect, the invention relates to a release for a bowstring comprising a substantially cylindrical housing bifurcated to provide an internal center slot, opening at a forward end of the housing, the slot adapted to receive a sear component pivotally secured in the housing and including a jaw movable between a first open position where the center slot is open and a second closed position where the jaw closes the center slot, the sear component further including a transverse locking edge; a trigger component pivotally secured in the housing and including means for holding the sear component in the second closed position, and for releasing the sear component for movement to the first open position; and a cocking hammer pivotably mounted in the housing including means for holding the sear component in the first open position and for moving the sear component to the second closed position.

Other objects and advantages of the subject invention will become apparent from the detailed description that follows.

DETAILED DESCRIPTION OF THE DRAWINGS

Figure 1:
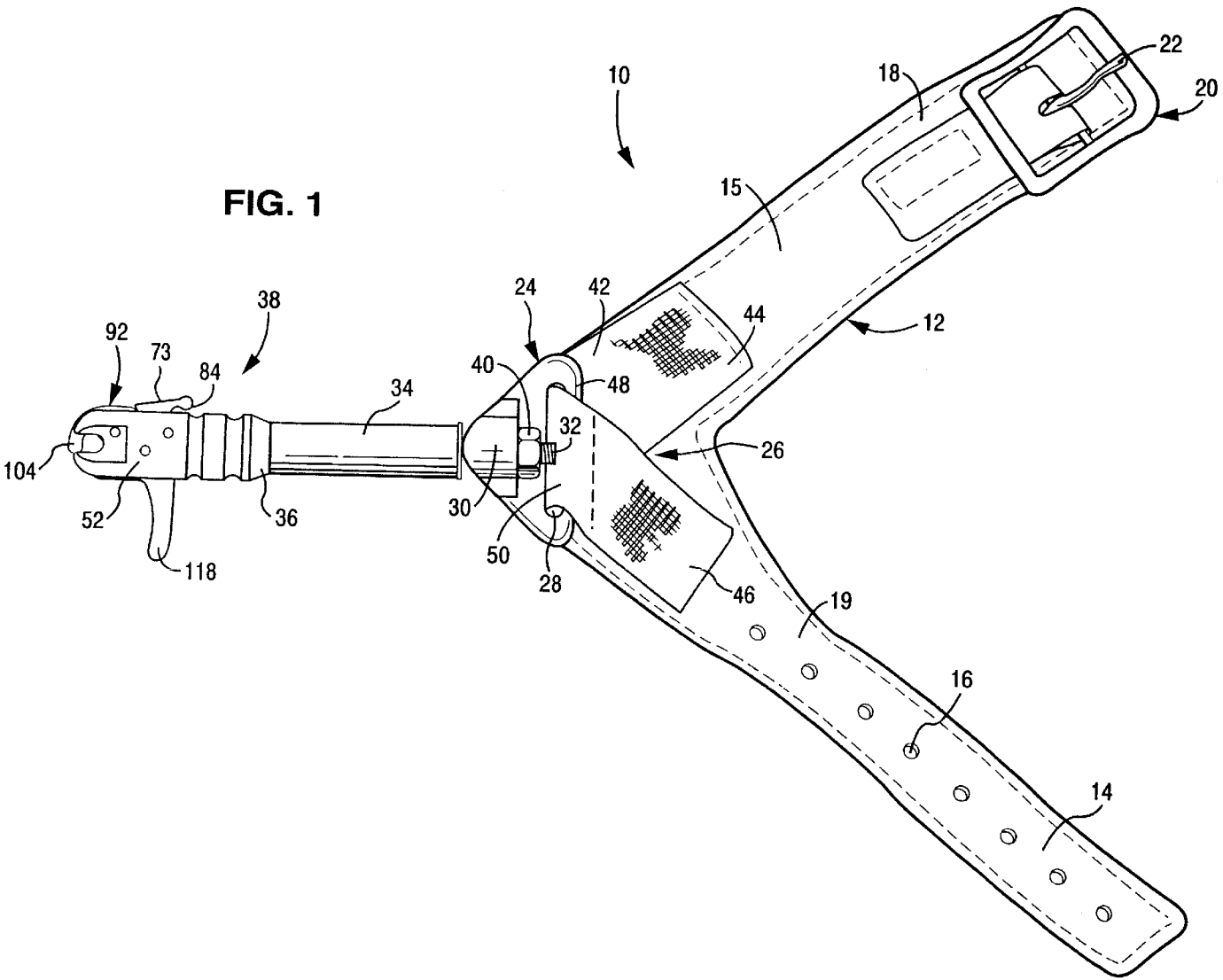
FIG. 1 is a plan view of the release and associated wrist strap in accordance with an exemplary embodiment of the invention.

With reference to FIG. 1, the bowstring loop release and wrist strap assembly 10, in accordance with one exemplary embodiment of the invention, generally includes a wrist strap 12, one end 14 of which is provided with a plurality of holes 16, and an opposite end 18 of which is provided with a conventional "belt buckle" 20 including a stem 22 adapted to fit within a selected hole 16 when the wrist strap is applied to the user's wrist. The wrist strap 12 has a generally V-shape with legs 15, 19 extending generally rearwardly from the apex 26, where the connector plate 24 is attached. The connector plate 24 serves to attach the loop release 28 to the wrist strap 12 as described further herein.

The connector plate 24 is generally triangularly shaped, with a slot 28 formed across the base of the triangle. At the apex of the triangle, there is a raised substantially cylindrical boss 30 having a smooth bore (not visible) adapted to receive a threaded shaft 32 that extends forwardly, through a spacer sleeve 34 and is fixed to a rearward end 36 of the release 38. The smooth bore through the cylindrical bushing 30 allows the shaft 32 to rotate freely therein. The shaft is held in place by a nut 40 which prevents separation of the release from the wrist strap. Nevertheless, it will be appreciated that the release 38 is free to rotate 360° about the axis of shaft 32 (and thus 360° relative to the connector plate 24 and wrist strap 12), thereby essentially eliminating any torque on the bowstring when the release is in use.

The connector plate 24 is secured to the wrist strap 12 by a fastening strap 42 that passes through the slot 28 and is then looped over the rearward edge of the connector plate, with opposite ends 44 and 46 of the fastening strap secured to respective leg portions 15 and 19 of the wrist strap 12. This arrangement allows the release 38 and connector plate 24 to be swung 180° from the position shown in FIG. 1, so as to overlie the back of the user's hand, freeing the hand for other activities. In this regard, the base 48 of the connector plate 24 combines with the transverse passage formed by the stitched loop 50 that passes through the slot 28 creates a "hinge" about which the release 38 and connector plate 24 can rotate.

Figure 2:
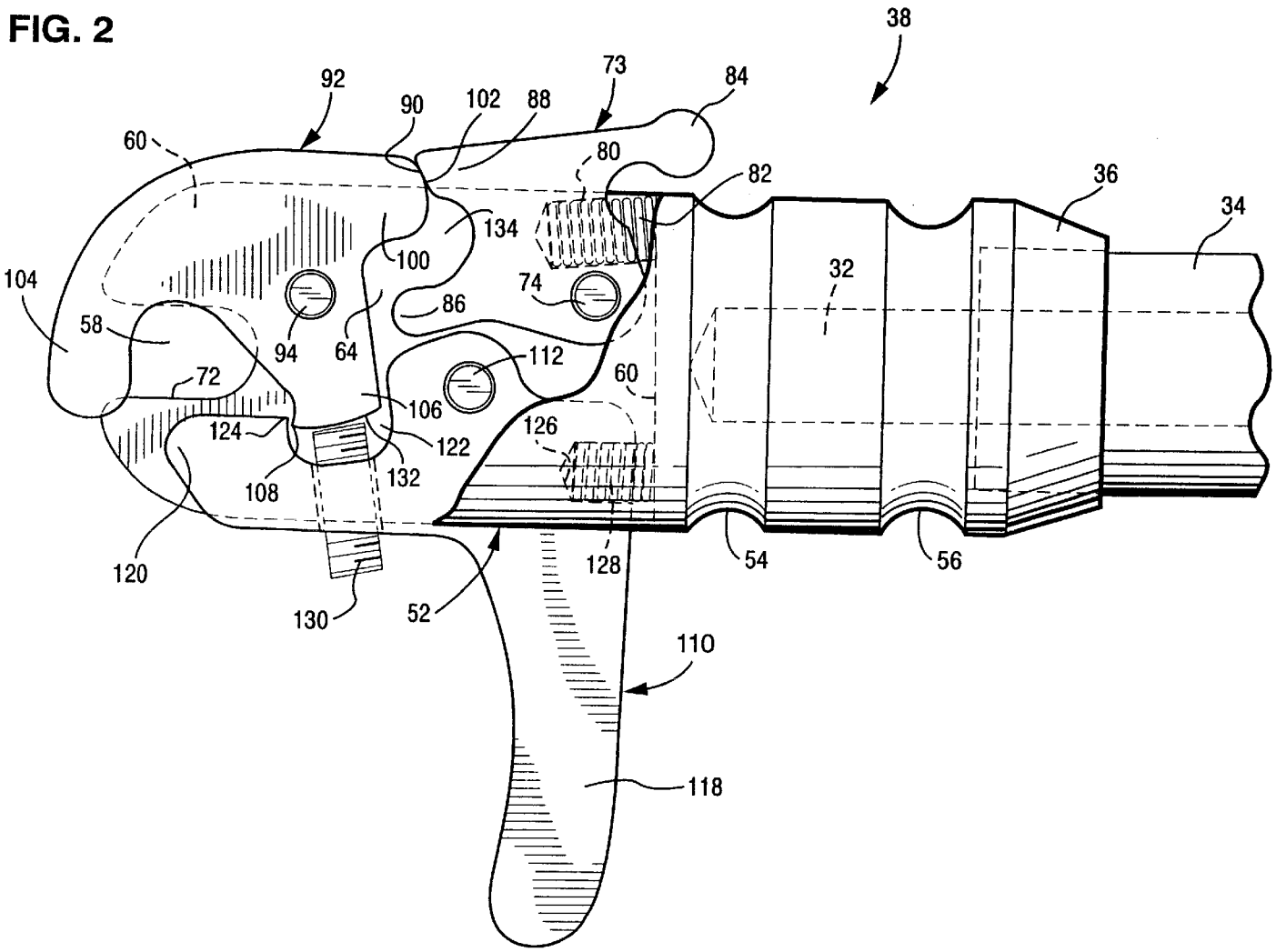
FIG. 2 is a partial plan view of the release only, with the release partially broken away to illustrate the mounting of the internal components thereof, the release shown in a closed position.
Figure 3:
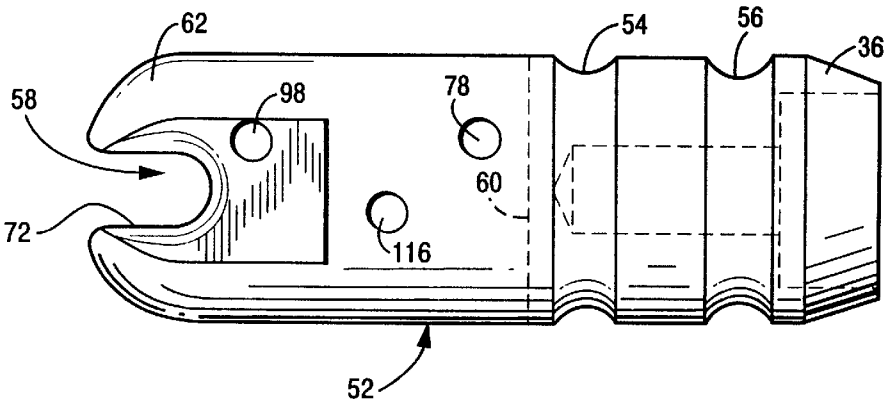
FIG. 3 is a side elevation of the release housing.
Figure 4:
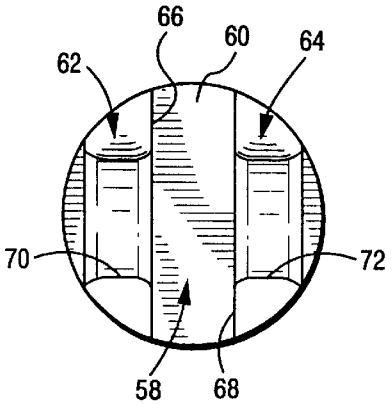
FIG. 4 is a front view of the release housing.

Turning now to FIGS. 2–4, the loop release device 38 includes a substantially cylindrical housing 52, the rearward end of which is crimped to the threaded shaft 32 and sleeve 34 assembly via grooves 54, 56. Forward of the groove 54, the housing 52 is bifurcated by an elongated center slot 58 (FIG. 4) that extends forwardly from an internal rear wall 60 to the forward end of the loop release, thus providing a pair of "arms" 62, 64 on either side of the center slot. This center slot 58 is formed with flat interior side walls 66, 68 and provides an interior space for mounting additional components of the release as described below. At the forward end of the housing 52, cut-outs or recesses 70, 72 are formed in the arms 62, 64, the recesses opening at the forward edges of the arms as best seen in FIGS. 2 and 3. The slot 58 and recesses 70, 72 are adapted to receive the release loop (or bowstring) when the release is in use, as further explained herein.

Figure 6:
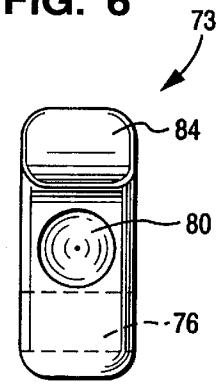
FIG. 6 is a rear elevation of the cocking lever shown in FIG. 5.
Figure 5:
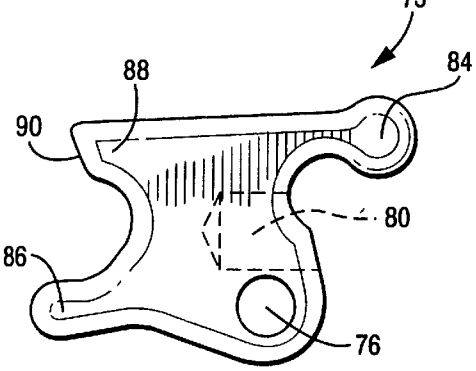
FIG. 5 is a side elevation of the cocking lever.

Three internal components are mounted within the cylindrical housing 52 in the slot 58, between flat interior side walls 66, 68. First, a cocking hammer 73 (also shown in FIGS. 5 and 6) is pivotally mounted within the housing, by means of a pin 74 that is inserted through a hole 76 in the hammer and held by press-fit in oppositely aligned holes 78 in the housing. The cocking hammer 73 includes a rearwardly directed blind bore 80 adapted to receive a coil spring 82 that is also engaged with the rear wall 60 of the housing. This spring biases the cocking hammer in a counterclockwise direction about pin 74, as viewed in FIG. 2.

The cocking hammer 73 also includes a finger button 84 and a forwardly projecting safety tab 86, the purpose for which will be described later herein. A forward projecting cocking tab 88 includes a surface 90 that allows the cocking hammer to be automatically re-cocked after the trigger is pulled, as also explained in detail below.

Figure 7:
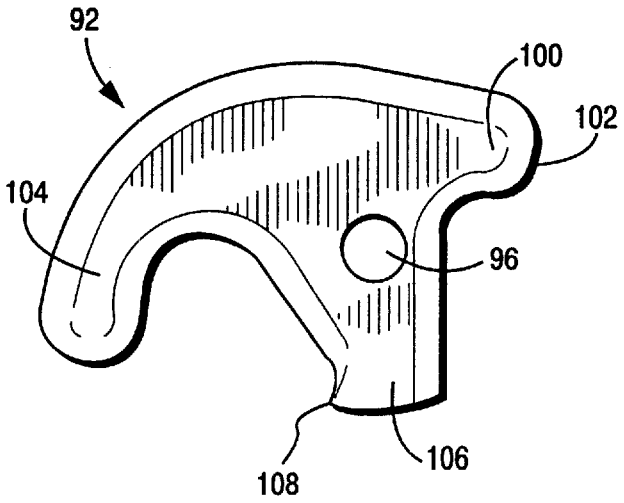
FIG. 7 is a side elevation of the sear component.
Figure 8:
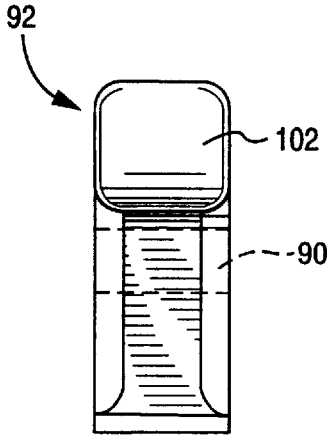
FIG. 8 is a rear elevation of the sear component shown in FIG. 7.

A sear component 92 (also shown in FIGS. 7 and 8) is similarly mounted within the housing 52, forward of the cocking hammer 73, by means of a pin 94 that passes through a hole 96 in the sear and is secured by press-fit in a pair of aligned holes 98 in the housing. The sear includes a rearward projection 100 having a surface 102 adapted to cooperate with the surface 90 on the cocking hammer 73. In addition, the sear includes a forwardly and downwardly projecting tongue or jaw 104 that, in one position, closes off the entry to the center slot 58. A downwardly and slightly rearwardly projecting portion 106 includes a forward locking edge 108 that is designed to interact with the trigger as described further below.

Figure 9:
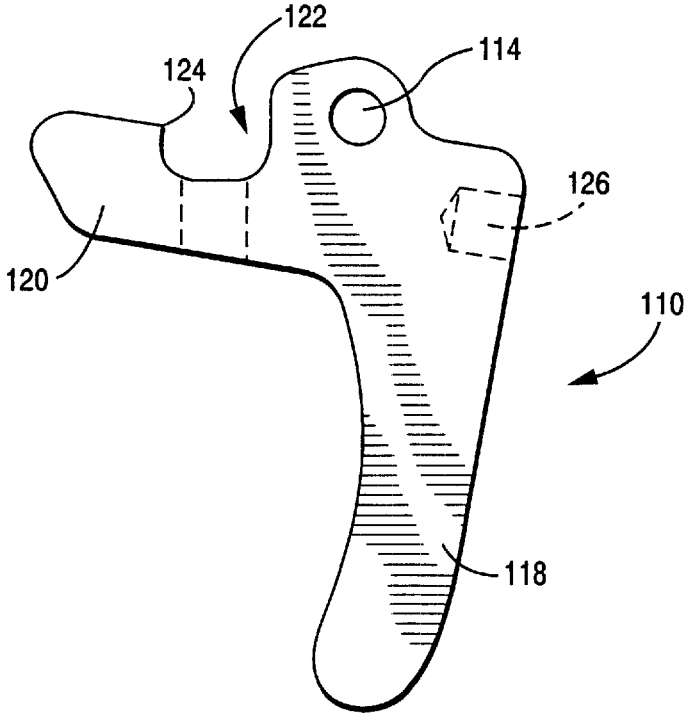
FIG. 9 is a side elevation of the trigger component.

The trigger component 110 (also shown in FIG. 9) is also pivotably mounted within the housing 52 by means of a pin 112 that passes through a hole 114 in the trigger and is secured by press-fit within a pair of oppositely aligned holes 116 in the housing 52, also by press-fit. The trigger component 110 also includes a finger trigger 118 that projects downwardly from the slot 58 in the release housing 52. The trigger 110 includes a forward projection 120 formed with an upwardly opening recess 122 that is adapted to partially receive portion 106 of the sear 92. A forward, relatively sharp, transverse release edge 124 of the recess 122 is designed to cooperate with the locking surface 108 on the sear 92 as further explained below.

Figure 2A:
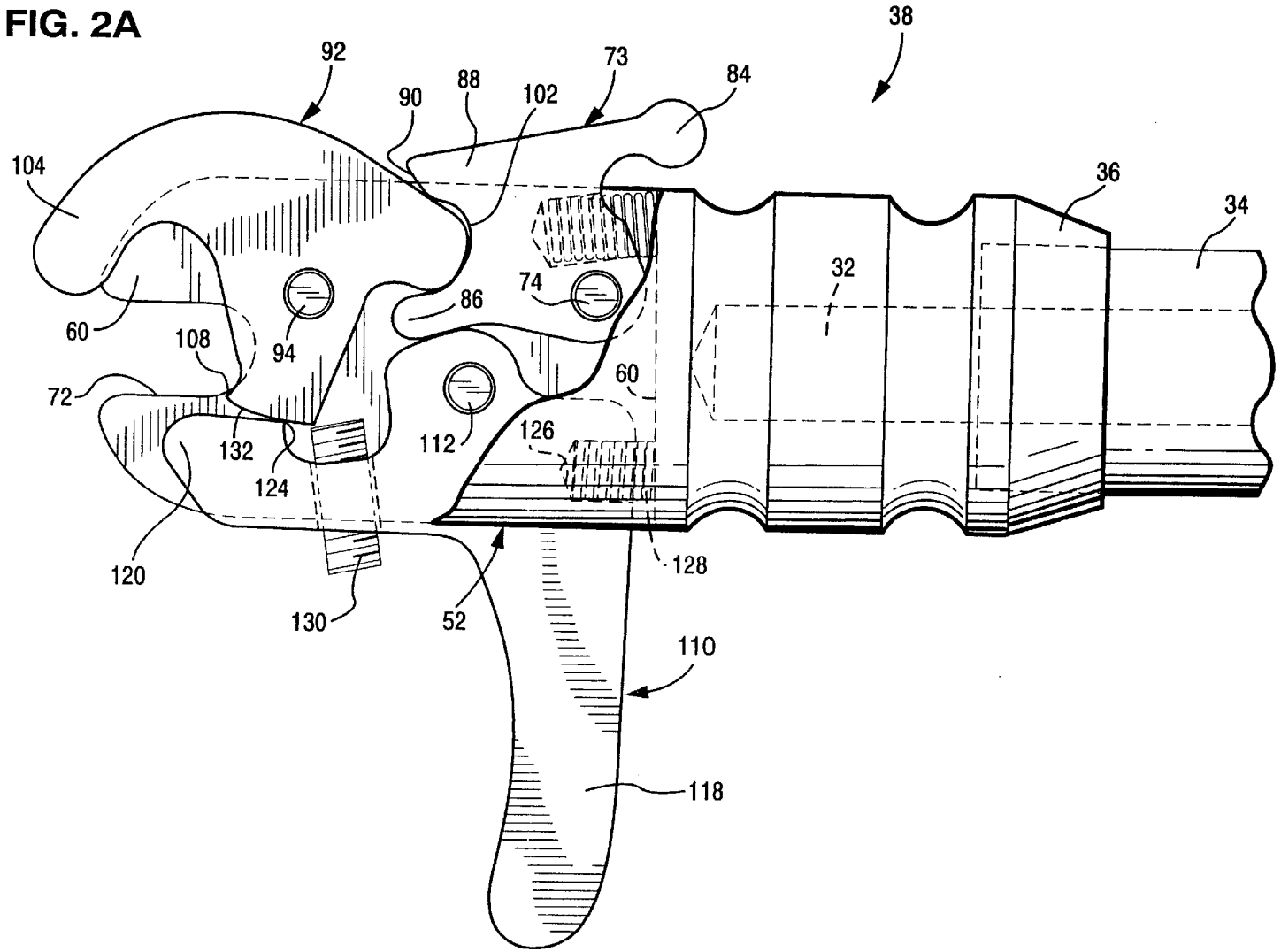
FIG. 2A is a partial plan view similar to FIG. 2 but with the release shown in a cocked or open position.

A blind hole 126 is formed at the rear of the trigger and is adapted to receive a coil spring 128 that also engages the rear wall 60 of the housing, thus biasing the trigger 110 in a clockwise direction about the pin 112 as viewed in FIGS. 2 and 2A.

FIG. 2 illustrates the release in ready-to-fire position. Note that the jaw 104 of the sear 92 is pivoted in counterclockwise direction about pin 94 to close the opening to center slot 58. In this position, the release loop would lie behind the jaw 104, lying in the slot 58 as well as in recesses 70, 72. The sear 92 is effectively locked in place by reason of the engagement locking edge 108 on the sear component with release edge 124 on the trigger. Note that a set screw 130 extending through the forward projection 120 of the trigger is adapted to engage the lower surface 132 of the sear 92, thus creating a desired spacing between the locking 108 and the release edge 124 that, in turn, determines trigger sensitivity. As shown, a high degree of sensitivity has been set, so that very little movement of the trigger is required to release the sear. A coil spring 128 biases the trigger in a clockwise direction, so that the sear locking edge 108 cannot clear the trigger release edge 124. At the same time, the cocking hammer 73 is in a neutral position, biased in counterclockwise direction by spring 82. Spring 82 is not strong enough to prevent the sear 92 from opening, however, as explained below. With the bowstring fully drawn and ready for firing, the user pulls the trigger rearwardly, against the bias of spring 128. As release edge 124 rotates downwardly, it engages and slides across the locking edge 108, thereby allowing the sear component to rotate in a clockwise direction about pin 94 such that the jaw portion 104 is free to move upwardly to an open position under the forward force of the loop rope or bowstring, releasing the bowstring or release loop.

The clockwise rotation of sear 92 overcomes the counter-biasing force of spring 82 with surface 102 of the sear engaging surface 90 of the cocking hammer 73 and causing the hammer to rotate clockwise about the pin 74. As the projection 100 and surface 102 of the sear pass the projection 88 and surface 90 on the cocking hammer, the projection 100 moves into the recess 134, and spring 82 then moves the sear back in a counterclockwise direction so that the cocking lever projection 88 overlies the sear component projection 100 to thereby hold the sear 92 in an open or cocked position as shown in FIG. 2A. Note in this position, the edge 124 of the trigger is engaged midway along the surface 132 of the sear. The release is now in position for re-loading a bowstring or release loop. When the bowstring or release loop is fully seated in the slot 58, the cocking hammer 73 is pressed downwardly, with projection 86 causing the hammer to rotate in a clockwise direction about pin 74 so that hammer projection 86 rotates the sear component in a counterclockwise direction about pin 94, with jaw 104 again closing the slot 58. Sear surface 132 rides across the trigger edge 124 until it passes over the edge 124 to the position shown in FIG. 2. The cocking hammer is then released and it also returns to the position shown in FIG. 2.

The cocking hammer 73 also provides an additional safety feature that can be explained in connection with FIG. 2. FIG. 2 illustrates the sear component 92 in its closed position. Assuming a loop rope or bowstring is loaded within the center slot 58, and the bowstring fully drawn, should the archer decide to "stand down," the cocking hammer 73 provides a safety mechanism in that the archer can depress the finger button 84, bringing the projection 86 of the cocking hammer up into engagement with the rearward projection 100 of the sear component 92. So long as the archer continues to depress the cocking hammer, the sear component cannot open. Thus, the archer, while holding the cocking hammer 73 in a depressed position, can ease off the trigger 10 without concern for an accidental firing of the arrow that might otherwise occur had the trigger been on the very edge of firing, or even if the trigger is pulled beyond its release position.

In the illustrated embodiments, it is preferable that the release housing be constructed of aluminum, while the sear component and trigger are preferably constructed of case hardened steel. The sear component and trigger may also be plated or coated for rust prevention.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A bowstring release device comprising:

a housing having a longitudinal axis and a center slot opening at a forward end thereof;

a sear component pivotably mounted in said housing, said sear component having a jaw movable between a first position where said center slot is open and a second position where said center slot is closed;

a trigger component pivotably mounted in said housing, said trigger component having a forward projection engageable with said sear component to hold the sear component in said second position and, when the trigger component is pulled, to allow said sear component to move to said first position; and a cocking hammer also pivotably mounted in said housing, said cocking hammer having a first forwardly extending projection adapted to engage and move said sear component to said second position when said cocking hammer is depressed.

2. The bowstring release device of claim 1 wherein said cocking hammer is pivotably mounted to said housing by means of a transverse pin, said cocking hammer having a second forwardly extending projection with a recess between said first and second forwardly extending projections, and wherein said cocking hammer is biased in a forward or counterclockwise direction about said transverse pin.

3. The bowstring release of claim 2 wherein said sear component is formed with a rearwardly extending projection adapted to seat within said recess when said sear component is in said first position.

4. The bowstring release of claim 3 wherein said second forwardly extending projection is adapted to hold said sear component in said first position until said cocking hammer is depressed.

5. The bowstring release of claim 4 wherein said first forwardly extending projection prevents said sear component from moving to said first position when said cocking hammer is depressed.

6. The bowstring release of claim 1 wherein a transverse, rearward facing release edge on said forward projection of said trigger component is engageable with a forward facing locking edge on said sear component when said sear component is in said second position.

7. The bowstring release of claim 6 wherein said transverse, rearward facing release edge forms a forward edge of a trigger recess in said forward projection of said trigger component, and wherein said forward facing locking edge on said sear component is located on a downward projection of said sear component, said downward projection of said sear component adapted to at least partially lie within said trigger recess when said sear component is in said second position, such that when said trigger is pulled, said rearward facing release edge moves into engagement with, and then past, said forward facing locking edge, thereby releasing said sear component for movement to said first position.

8. The bowstring release of claim 7 wherein a set screw extends through said trigger component, into said trigger recess and engaging a lower surface of said downward projection of said sear component when said sear component is in said second position, said set screw serving to adjust the position of said trigger component relative to said sear component.

9. The bowstring release of claim 1 wherein said housing is constructed of aluminum and said sear and trigger components are constructed of steel.

10. A release for a bowstring comprising a substantially cylindrical housing bifurcated to provide an internal center slot, opening at a forward end of the housing, said slot adapted to receive a sear component pivotally secured in said housing and including a jaw movable between a first open position where said center slot is open and a second closed position where said jaw closes said center slot, said sear component further including a transverse locking edge;

a trigger component pivotally secured in said housing and including means for holding said sear component in said second closed position, and for releasing said sear component for movement to said first open position; and a cocking hammer pivotably mounted in said housing including means for holding said sear component in said first open position and for moving said sear component to said second closed position.

11. The release of claim 10 and further comprising a wrist strap and a connector by which the release is pivotably connected to the wrist strap.

12. The release of claim 11 including an elongated shaft between the release and the connector, and wherein the release and the shaft are freely rotatable about a longitudinal axis of the shaft.

13. The release of claim 10 and further comprising a wrist strap and a connector by which the release is pivotably connected to the wrist strap for rotation about an axis substantially perpendicular to said longitudinal axis.

* * * * *